US007629737B2

(12) United States Patent
Yotani et al.

(10) Patent No.: US 7,629,737 B2
(45) Date of Patent: Dec. 8, 2009

(54) FLUORESCENT DISPLAY DEVICE

(75) Inventors: Junko Yotani, Mie (JP); Sashiro Uemura, Mie (JP)

(73) Assignee: Noritake Co., Ltd., Aichi (JP)

( * ) Notice: Subject to any disclaimer, the term of this patent is extended or adjusted under 35 U.S.C. 154(b) by 322 days.

(21) Appl. No.: 11/805,582

(22) Filed: May 23, 2007

(65) Prior Publication Data

US 2008/0061675 A1 Mar. 13, 2008

(30) Foreign Application Priority Data

Sep. 12, 2006 (JP) ..... 2006-246453

(51) Int. Cl.
*H01J 19/28* (2006.01)

(52) U.S. Cl. ..... 313/497; 313/308

(58) Field of Classification Search ..... None
See application file for complete search history.

(56) References Cited

U.S. PATENT DOCUMENTS

| | | | | |
|---|---|---|---|---|
| 6,522,055 | B2 | 2/2003 | Uemura et al. | |
| 7,492,088 | B2 * | 2/2009 | Jang et al. | 313/496 |
| 7,504,768 | B2 * | 3/2009 | Oh | 313/497 |
| 7,511,414 | B2 * | 3/2009 | Park et al. | 313/497 |
| 7,514,858 | B2 * | 4/2009 | Yoo et al. | 313/496 |
| 2006/0076881 | A1 * | 4/2006 | Kim et al. | 313/496 |
| 2006/0145594 | A1 | 7/2006 | Yotani et al. | |
| 2006/0192476 | A1 * | 8/2006 | Wei et al. | 313/495 |

FOREIGN PATENT DOCUMENTS

| | | |
|---|---|---|
| JP | 2001-146050 A | 5/2001 |
| JP | 2002-343281 A | 11/2002 |
| JP | 2006-164825 A | 6/2006 |

* cited by examiner

*Primary Examiner*—Ashok Patel
(74) *Attorney, Agent, or Firm*—Blakely, Sokoloff, Taylor & Zafman LLP

(57) ABSTRACT

A fluorescent display device includes a front glass at least part of which is translucent, a substrate, a cathode, an electron-emitting layer, an electron extracting electrode, a phosphor film and an anode, and a conductive layer. The substrate is formed of an insulating member arranged to oppose the front glass. The front glass and the substrate constitute part of a vacuum envelope. The cathode is disposed on the substrate. The electron-emitting layer includes a carbon nanotube and is formed on a surface of the cathode. The electron extracting electrode is arranged between the substrate and the front glass to be spaced apart from the cathode. The phosphor layer and the anode stack on a surface of the front glass which opposes the substrate. The conductive layer is formed between the cathode and the substrate.

4 Claims, 3 Drawing Sheets

FLUORESCENT DISPLAY DEVICE

BACKGROUND OF THE INVENTION

The present invention relates to a triode-structure fluorescent display device which uses an electron-emitting source comprising a carbon nanotube.

A field emission type electron-emitting source using carbon nanotubes attracts attention as an electron-emitting source for a fluorescent display device such as an FED (Field Emission Display) or vacuum fluorescent display. In a carbon nanotube, a graphite single layer closes cylindrically, and a 5-membered ring is formed at the distal end of the cylinder. Since the carbon nanotube has a typical diameter of as very small as 10 nm to 50 nm, upon application of an electric field of about 100 V, it can field-emit electrons from its distal end. Carbon nanotubes include those with a single-layered structure described above and those with a coaxial multilayered structure in which a plurality of graphite layers stack to form a telescopic structure and each graphite layer closes cylindrically. Either type can be used to form an electron-emitting source (see U.S. Pat. No. 6,522,055).

A field emission type electron-emitting source using conventional typical carbon nanotubes comprises a flat substrate electrode in which many carbon nanotubes are arranged. By applying a high voltage across the substrate electrode and an electron extracting electrode opposing it, the electric field is concentrated to the distal ends of the carbon nanotubes to emit electrons from them. A method of manufacturing such an electron-emitting source includes, as is known well, one that uses a substrate made of a metal including iron or nickel and forms a film formed of carbon nanotubes on the surface of the substrate and the wall of a through hole wall in accordance with thermal CVD (Chemical Vapor Deposition). When manufacturing carbon nanotubes according to this method, the electron emission uniformity improves, and a state in which a chain of destructive phenomena due to local field concentration does not easily occur can be obtained.

As a fluorescent display device which uses such an electron-emitting source, a triode-structure FED (flat panel display) shown in FIG. 4A has been proposed (see Japanese patent Laid-Open No. 2002-343281). This flat panel display comprises a glass substrate 401 and a translucent front glass 408 arranged to oppose the glass substrate 401. The two end faces of a frame-like spacer glass (not shown) adhere to the peripheral portions of the glass substrate 401 and front glass 408 through low-melting frit glass. The glass substrate 401, the front glass 408, and the spacer glass form an envelope. The interior of the envelope is maintained at a vacuum degree on the order of $10^{-5}$ Pa.

A plurality of substrate ribs 402 standing vertically to be parallel to each other are disposed on the glass substrate 401. Electron-emitting sources 403 are disposed on the glass substrate 401 sandwiched by the substrate ribs 402. As shown in FIG. 4B, each electron-emitting source 403 comprises an electrode portion 431 serving as a cathode, and an electron-emitting layer 432 formed on the surface of the electrode portion 431. The electron-emitting layer 432 comprises carbon nanotubes which are formed on the surface of the electrode portion 431, made of an alloy of iron, nickel, or the like, by CVD using a carbon source gas such as methane or carbon monoxide. In the electron-emitting layer 432, a plurality of fibrous carbon nanotubes entangle each other to form a cotton-like layer with a thickness of about 5 μm to 50 μm.

Each electron-emitting source 403 (electrode portion 431) forms a strip-like shape extending in the same direction as the substrate ribs 402, and includes openings at predetermined intervals. In other words, each electron-emitting source 403 forms a ladder-like shape. A plurality of electron extracting electrodes 404 extend on the substrate ribs 402 in a direction perpendicular to the substrate ribs 402. The plurality of electron extracting electrodes 404 are arranged at predetermined intervals in a direction perpendicular to the substrate ribs 402. Each electron extracting electrode 404 has electron-passing holes 404*a* at predetermined intervals to form a ladder-like shape.

Front ribs 405, extending in a direction perpendicular to the substrate ribs 402 and standing vertically to be parallel to each other, are formed on the substrate ribs 402. In the envelope, the front glass 408 is supported on the substrate ribs 402 through the front ribs 405. The front ribs 405 are disposed on the substrate ribs 402 at gaps to correspond to the electron extracting electrodes 404. In other words, on the substrate ribs 402, the electron extracting electrodes 404 are disposed each between the two adjacent front ribs 405.

Phosphor layers 407R, 407G, and 407B, and metal-backed films 406 which serve as anodes to cover the phosphor layers 407R, 407G, and 407B, stack on the inner surface of the envelope of the front glass 408. On the inner surface of the envelope of the front glass 408, the phosphor layers 407R, 407G, and 407B are sequentially arranged each between the two adjacent front ribs 405. The phosphor layer 407R comprises a red-emitting phosphor. The phosphor layer 407G comprises a green-emitting phosphor. The phosphor layer 407B comprises a blue-emitting phosphor.

In the flat panel display having the above arrangement, a predetermined potential difference is applied between the electron extracting electrodes 404 and electron-emitting sources 403 such that the electron extracting electrodes 404 side has a positive potential. This extracts electrons from the distal ends of the carbon nanotubes that form the electron-emitting layers 432 at regions where the electron extracting electrodes 404 and electron-emitting sources 403 intersect, and the extracted electrons are emitted from the rectangular electron-passing holes 404*a* of the electron extracting electrodes 404. At this time, if a positive voltage (acceleration voltage) is applied to the metal-backed films 406, it accelerates the electrons emitted from the electron-passing holes 404*a* toward the metal-backed films 406. The accelerated electrons are transmitted through the metal-backed films 406 and bombard the phosphor layers 407R, 407G, and 407B to cause them to emit light.

For example, with the metal-backed films 406 being applied with a positive voltage and a predetermined electron-emitting source 403 being applied with a predetermined negative voltage, assume that a positive voltage is applied to a predetermined electron extracting electrode 404. This can selectively cause any one of the phosphor layers 407R, 407G, and 407B, which corresponds to a portion where the row of the electron-emitting source 403 applied with the negative voltage and the column of the electron extracting electrode 404 applied with the positive voltage intersect, to emit light. The intersecting portion described above corresponds to one display dot of the flat panel display.

In the conventional flat panel display described above, an abnormal dot may be present which constantly emits light even when it is not selected, and some electron-emitting source 403 (electrode portion 431) may vibrate during operation to generate abnormal noise. These problems arise due to the following factors. During the operation, an electric field from an electron extracting electrode 404 applied with the voltage causes the corresponding electron-emitting layer 432 to emit electrons. Some of the emitted electrons may accumulate on the surface of the glass substrate 401 to charge it.

SUMMARY OF THE INVENTION

It is an object of the present invention to provide a fluorescent display device in which generation of an abnormal dot which constantly emits light during operation is suppressed, and abnormal vibration of an electrode portion serving as a cathode is suppressed.

In order to achieve the above object, according to the present invention, there is provided a fluorescent display device comprising a front glass at least part of which is translucent, a substrate which is formed of an insulating member arranged to oppose the front glass, the front glass and the substrate constituting part of a vacuum envelope, a cathode which is disposed on the substrate, an electron-emitting layer which comprises a carbon nanotube and is formed on a surface of the cathode, an electron extracting electrode which is arranged between the substrate and the front glass to be spaced apart from the cathode, a phosphor film and an anode which stack on a surface of the front glass which opposes the substrate, and a conductive layer which is formed between the cathode and the substrate.

DESCRIPTION OF THE PREFERRED EMBODIMENTS

Figure 1:
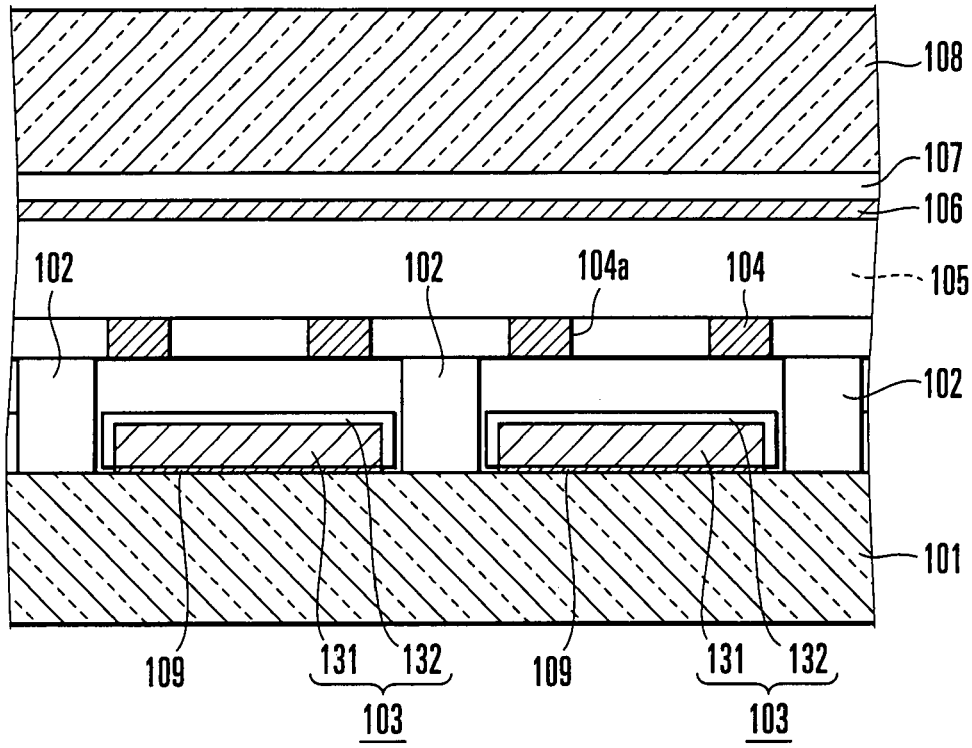
FIG. 1 is a sectional view of the main part of a fluorescent display device according to the first embodiment of the present invention.

A fluorescent display device according to the first embodiment of the present invention will be described with reference to FIG. 1. In FIG. 1, the fluorescent display device will be exemplified by a flat panel display. The fluorescent display device according to this embodiment comprises a substrate 101 made of an insulating material such as glass and at least part of which is translucent, a plurality of substrate ribs 102 disposed on the substrate 101 to be parallel to each other, a plurality of electron-emitting sources 103 disposed on the substrate 101 between the substrate ribs 102, a plurality of electron extracting electrodes 104 supported on the substrate ribs 102, a plurality of front ribs 105 supported on the substrate ribs 102 at gaps to correspond to the electron extracting electrodes 104, a translucent front glass 108 supported on the front ribs 105, and R, G, and B phosphor layers 107 and metal-backed films 106 sequentially stacked on that surface of the front glass 108 which opposes the substrate 101.

Figure 4A:
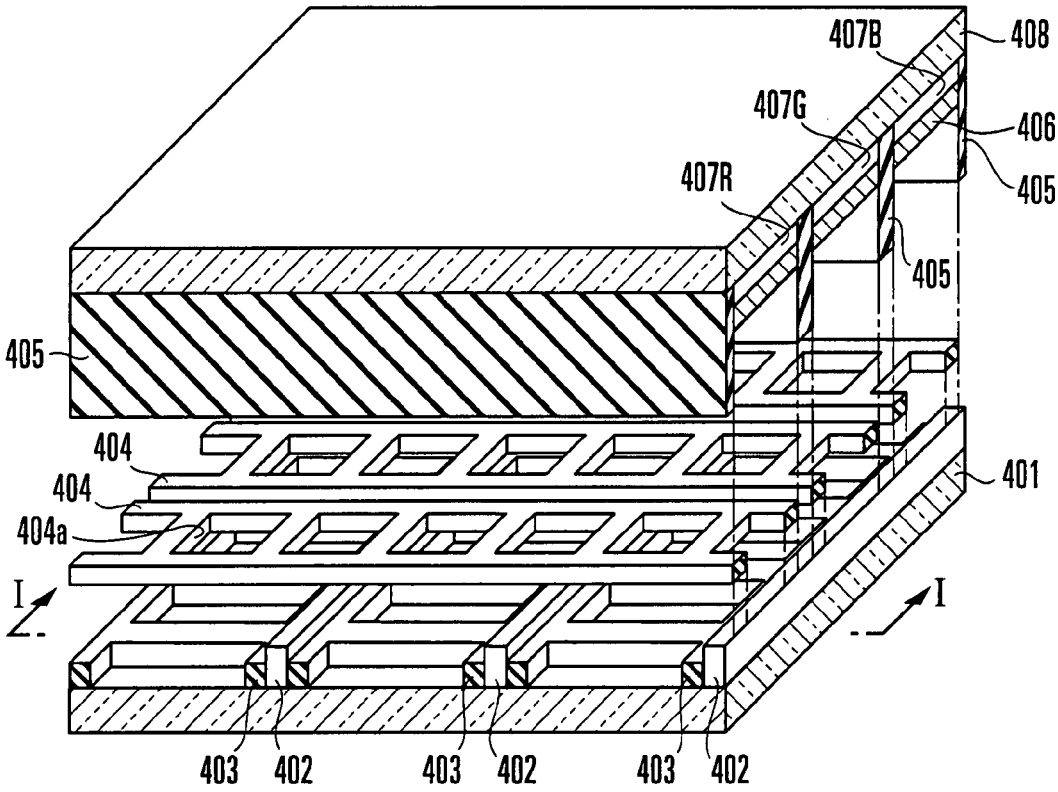
FIG.4A PRIOR ART
FIG. 4A is a perspective view showing the main part of a conventional flat panel display.
Figure 4B:
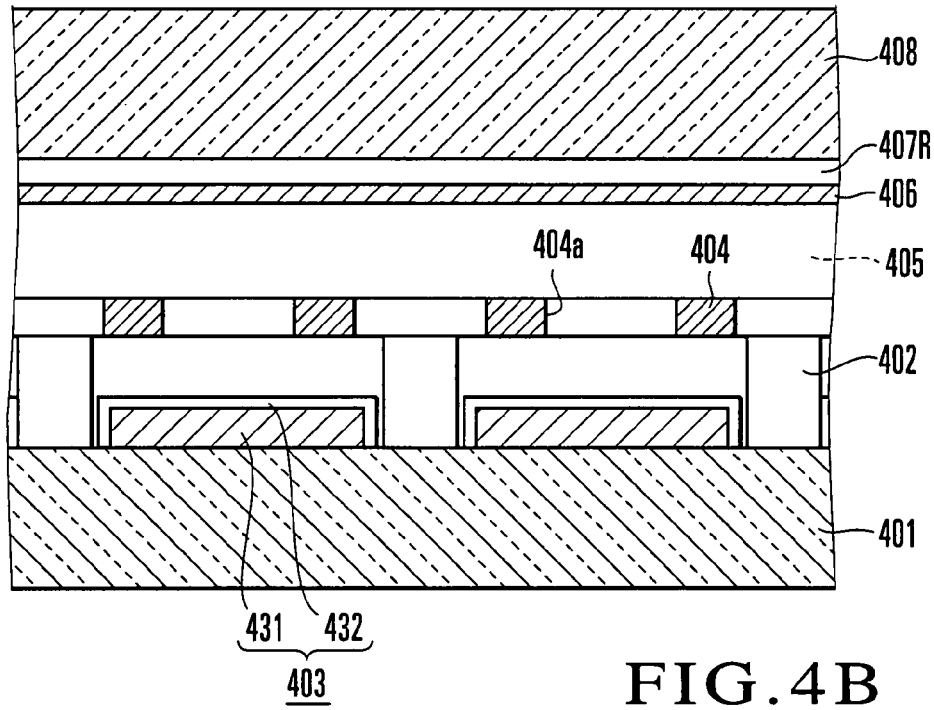
FIG.4B PRIOR ART
FIG. 4B is a sectional view taken along the line I-I of FIG. 4A.

The substrate 101, plurality of substrate ribs 102, plurality of electron-emitting sources 103, plurality of electron extracting electrodes 104, plurality of front ribs 105, front glass 108, phosphor layers 107, and metal-backed films 106 described above form the same structure as that formed by the glass substrate 401, plurality of substrate ribs 402, plurality of electron-emitting sources 403, plurality of electron extracting electrodes 404, plurality of front ribs 405, front glass 408, phosphor layers 407R, 407G, and 407B, and metal-backed films 406 shown in FIGS. 4A and 4B.

The substrate 101 and front glass 108 are arranged to oppose each other at a predetermined distance. The two end faces of a frame-like spacer glass (not shown) adhere to the peripheral portions of the substrate 101 and front glass 108 through low-melting frit glass. The substrate 101, the front glass 108, and the spacer glass form an envelope. The interior of the envelope is maintained at a vacuum degree on the order of $10^{-5}$ Pa.

The plurality of substrate ribs 102 stand vertically on the substrate 101 to extend parallel to each other. The substrate ribs 102 are made of a conductive material considering charging on the surfaces. The plurality of strip-like electron-emitting sources 103 (split electron-emitting sources) are disposed on those regions of the substrate 101 each of which is sandwiched by the two adjacent substrate ribs 102, to extend in the same direction as that of the substrate ribs 102. In other words, the plurality of electron-emitting sources 103 are arranged parallel to each other to sandwich the substrate ribs 102 in between. Each electron-emitting source 103 comprises an electrode portion 131 (split electrode) serving as a cathode, and an electron-emitting layer 132 formed on the surface of the electrode portion 131. Each electron-emitting source 103 has openings at predetermined intervals in the longitudinal direction to form a ladder-like shape.

The electron-emitting layer 132 comprises carbon nanotubes which are formed on the surface of the electrode portion 131, made of an alloy of iron, nickel, or the like, by CVD using a carbon source gas such as methane or carbon monoxide. In the electron-emitting layer 132, a plurality of fibrous carbon nanotubes entangle each other to form a cotton-like layer with a thickness of about 5 μm to 50 μm.

The plurality of strip-like electron extracting electrodes 104 (split electrodes) disposed on the plurality of substrate ribs 102 extend parallel to each other in a direction perpendicular to the substrate ribs 102. Each electron extracting electrode 104 has a ladder-like shape in which rectangular electron-passing holes 104*a* are formed at predetermined intervals in the longitudinal direction. The plurality of electron extracting electrodes 104 are arranged at predetermined intervals in a direction along which the substrate ribs 102 line up.

On the substrate ribs 102 between the adjacent electron extracting electrodes 104, the plurality of front ribs 105 are disposed to extend in a direction perpendicular to the substrate 101. In other words, the electron extracting electrodes 104 are disposed on regions partitioned by the adjacent front ribs 105. On the inner surface of the envelope of the front glass 108, the R, G, and B phosphor layers 107 are formed in a predetermined order in the respective regions partitioned by the adjacent front ribs 105. The metal-backed films 106 serving as anodes are formed to cover the phosphor layers 107. The phosphor layer R comprises a red-emitting phosphor. The phosphor layer G comprises a green-emitting phosphor. The phosphor layer B comprises a blue-emitting phosphor. The arrangement described above is the same as that of the conventional flat panel display shown in FIGS. 4A and 4B.

In the fluorescent display device according to this embodiment, in addition to the arrangement described above, a plurality of conductive layers 109 (split conductive layers) are provided between the respective electrode portions 131 of the electron-emitting sources 103 and the substrate 101 in order to suppress charging between the substrate 101 and the respective electrode portions 131. More specifically, the electrode portions 131 are disposed on the conductive layers 109 after forming the conductive layers 109 on the substrate 101 to have the same pattern as that of the electrode portions 131. The conductive layers 109 are formed on the substrate 101 between the adjacent substrate ribs 102, to extend in the same direction as those of the substrate ribs 102 and electron-emitting sources 103. The conductive layers 109 are insulated and isolated from each other.

The conductive layers 109 are formed of a conductive material such as aluminum, ITO (Indium-Tin-Oxide), or the like into film layers each with a thickness of several μm to several ten μm. For example, the conductive layers 109 can be formed on the substrate 101 by forming ITO films by screen printing. The conductive layers 109 can also be formed by depositing aluminum by sputtering or vacuum vapor deposition. When forming the conductive layers 109 from a metal such as aluminum, they may be formed into meshes, e.g., hexagonal meshes, with pitches of several μm to several hundred μm. The conductive layers 109 need not be evenly formed on the entire formation region.

The effect of the conductive layers 109 will be described. In the fluorescent display device described above, a predetermined potential difference is supplied between the electron extracting electrodes 104 and electron-emitting sources 103 such that the electron extracting electrodes 104 side has a positive potential. This extracts electrons from the distal ends of the carbon nanotubes that form the electron-emitting layers 132 at regions where the electron extracting electrodes 104 and electron-emitting sources 103 intersect, and the extracted electrons are emitted from the rectangular electron-passing holes 104*a* of the electron extracting electrodes 1404. At this time, some of the extracted electrons leak to the substrate 101 side as well. If no conductive layers 109 are provided, as in the conventional case, the leaking electrons accumulate on the surface of the substrate 101 to charge those portions of the surface of the substrate 101 which are on the regions of the electrode portions 131 to a negative potential.

When the electron-emitting sources 103 are to emit electrons to perform display operation, a negative potential is applied to the electrode portions 131. Hence, the electrode portions 131 receive negative-potential repulsive forces and vibrate to generate abnormal noise. The repulsive forces adversely influence the electrode portions 131 as well as the electron-emitting layers 132. More specifically, some of the carbon nanotubes of the electron-emitting layers 132 that have received the repulsive forces project toward the electron extracting electrodes 104 to cause abnormal light emission.

These problems arise due to the electron accumulation on the surface of the substrate 101. By providing the conductive layers 109 between the substrate 101 and electrode portions 131, electron accumulation on the surface of the substrate 101 is suppressed to solve the problems described above. The conductive layers 109 having the same pattern as that of the electrode portions 131 are arranged only between the substrate 101 and electrode portions 131. Alternatively, strip-like conductive layers 109 may be formed to cover regions between the adjacent substrate ribs 102.

Figure 2:
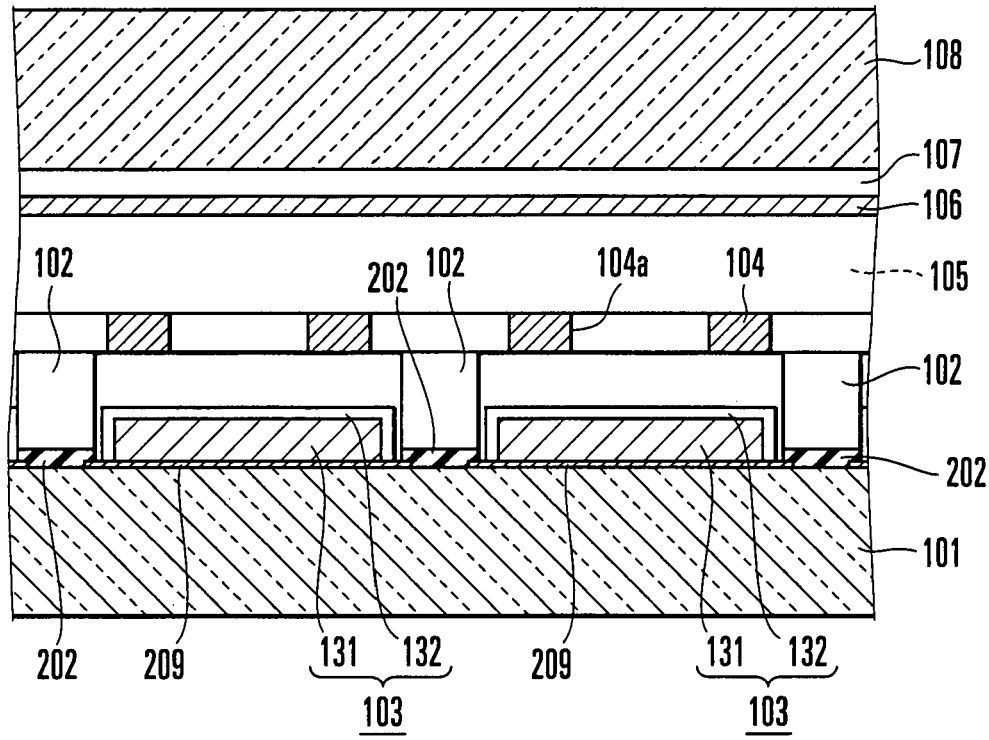
FIG. 2 is a sectional view of the main part of a fluorescent display device according to the second embodiment of the present invention.

In the first embodiment described above, spaces are reserved between the adjacent substrate ribs 102, and the conductive layers 109 are respectively arranged in the spaces. However, the present invention is not limited to this. For example, as shown in FIG. 2, conductive portions 209 may be arranged such that the two side portions in the extending direction of each conductive portion 209 are present between the lower portions of substrate ribs 102 and a substrate 101. The conductive layer 209 is formed to cover the surface of the substrate 101 between the adjacent substrate ribs 102. In this case, the lower portion of each substrate rib 102 which is in contact with the conductive layer 209 is formed of an insulating member 202. This insulates and isolates the adjacent conductive layers 209 from each other.

The present invention is not limited to the triode-structure fluorescent display device described above, but can naturally be applied to another triode-structure fluorescent display device. For example, the present invention can also be applied to flat panel displays shown in U.S. Pre-Grant Publication No. 2006/0145594 and Japanese Patent Laid-Open No. 2006-164825.

Figure 3:
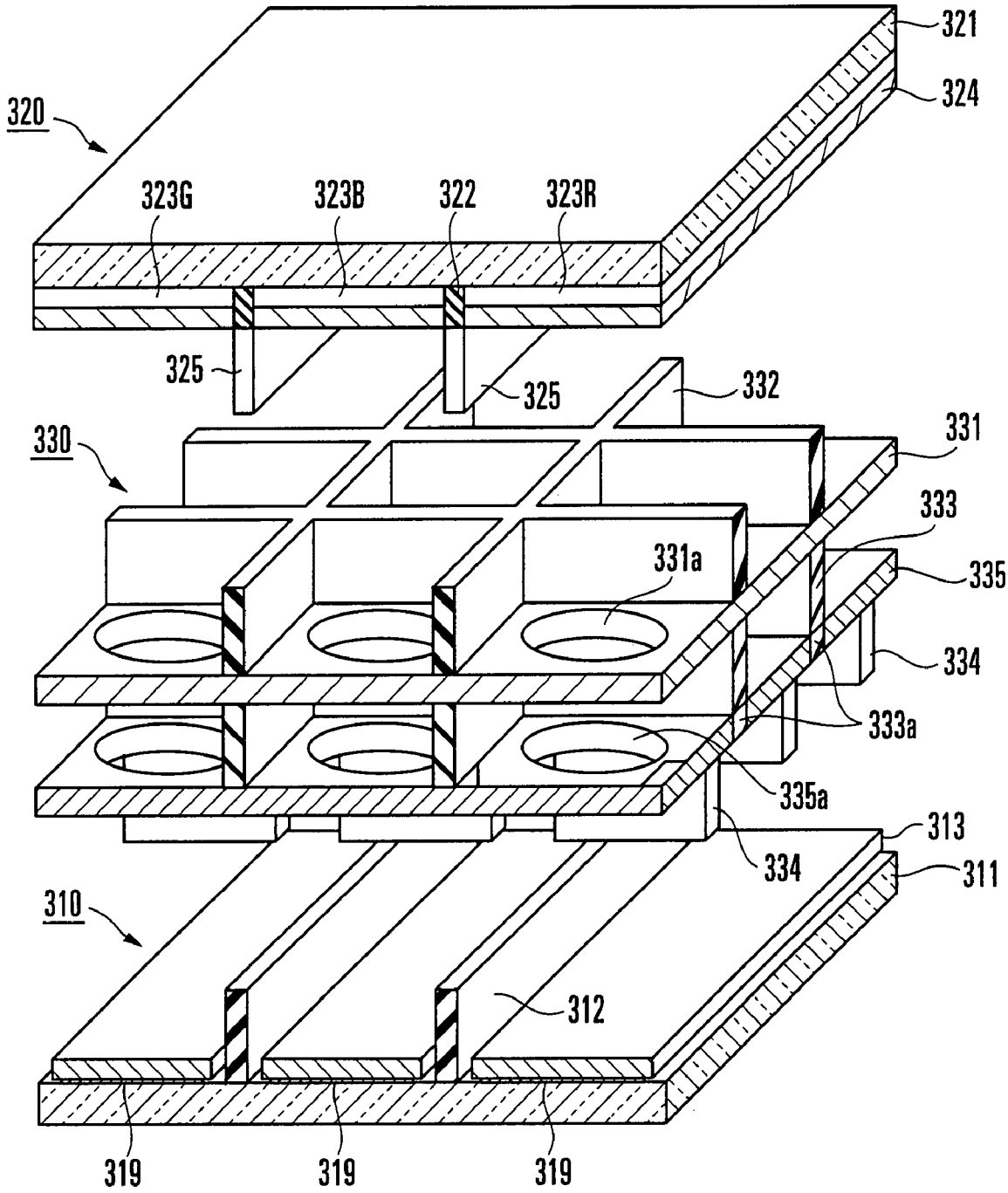
FIG. 3 is a perspective view of the main part of a fluorescent display device according to the third embodiment of the present invention.

The present invention can also be applied to a flat panel display shown in FIG. 3. In the flat panel display shown in FIG. 3, a cathode substrate 310 having a plurality of cathodes 313 is disposed on a glass substrate 311. An anode substrate 320 having phosphor films 323G, 323B, and 323R and metal-backed films 324 serving as anodes is formed on the inner surface of a front glass 321 at least part of which is translucent. A gate substrate 330 is disposed almost parallel to the substrate 311 and front glass 321. The gate substrate 330 comprises one flat electrode 331 serving as a field control electrode, and a gate substrate 330 having a plurality of band (strip)-like gate electrodes 335.

The substrate 311 and front glass 321 oppose each other through a frame-like spacer glass (not shown) provided to their peripheral portions. The substrate 311 and front glass 321 adhere to the two end faces of the spacer glass through low-melting frit glass to form an envelope. The interior of the envelope is maintained at a vacuum degree on the order of $10^{-5}$ Pa. In the following description, the vertical direction, the direction of depth, and the right-and-left direction of FIG. 3, when seen from the front, correspond to the direction of height, the longitudinal direction, and the lateral direction, respectively. In the direction of height, the cathode substrate 310 side corresponds to the lower side.

In the cathode substrate 310, a plurality of substrate ribs 312 stand vertically to be parallel to each other at a predetermined interval on that surface of the glass substrate 311 which opposes the gate substrate 330 to support the gate substrate 330. The cathodes 313 are disposed to form strips on those regions on the glass substrate 311 which are sandwiched by the substrate ribs 312. In each cathode 313, an electron-emitting source formed of nanotube fibers such as carbon nanotubes or carbon nanofibers fixes to the surface of a metal member. The cathodes 313 correspond to the electron-emitting sources 103 shown in FIG. 1. The cathodes 313 are arranged such that their upper surfaces are lower than the upper end faces of the substrate ribs 312.

The gate substrate 330 disposed in the envelope comprises a plurality of rod-like inter-gate-electrode insulating members 333*a* which extend parallel to each other in a direction perpendicular to the substrate ribs 312 of the cathode substrate 310 and are supported by the substrate ribs 312. The respective gate electrodes 335 are arranged each between the two adjacent inter-gate-electrode insulating members 333*a* and are supported by the substrate ribs 312. The gate electrodes 335 correspond to the electron extracting electrodes 104 shown in FIG. 1. The gate electrodes 335, together with the inter-gate-electrode insulating members 333*a*, extend in a direction perpendicular to the substrate ribs 312. An intermediate rib 333 having an almost grid-like shape when seen from the top is disposed on the inter-gate-electrode insulating members 333*a* and gate electrodes 335. Those portions of the intermediate rib 333 which are parallel to the extending direction of the gate electrodes 335 are disposed on the inter-gate-electrode insulating members 333*a*.

The gate substrate 330 comprises the conductive plate-like flat electrode 331 supported by the intermediate rib 333, and an anode rib 332 having an almost grid-like shape when seen from the top and disposed on the flat electrode 331. A plurality of cathode ribs 334, arranged to be spaced apart from each other at predetermined distances in the longitudinal direction of the inter-gate-electrode insulating members 333*a*, are formed on the lower surfaces of the inter-gate-electrode insulating members 333*a* on the cathode substrate 310 side. The cathode ribs 334 support the inter-gate-electrode insulating members 333*a* on the cathodes 313. Accordingly, the substrate ribs 312 and cathode ribs 334 support the inter-gate-electrode insulating members 333*a*.

Each gate electrode 335 has a plurality of through holes 335*a* spaced apart from each other at predetermined distances in the longitudinal direction along which it extends. The flat electrode 331 has a plurality of through holes 331*a* like a matrix to correspond to the through holes 335*a*. The intermediate rib 333 and anode rib 332 are arranged to overlap when seen from the top, and the through holes 331*a* and 335*a* are arranged in the openings of the grids (grid openings). The through hole arranged to correspond to the coincident grip opening forms one pixel of the flat panel display. On each cathode 313 between the adjacent substrate ribs 312, the cathode ribs 334 separate the pixels.

In the flat panel display having the above arrangement, a predetermined potential difference is supplied between the gate substrate 330 and cathodes 313 such that the gate substrate 330 has a positive potential. Thus, the electrons extracted from those regions of the cathodes 313 which intersect the gate electrodes 335 are emitted outside the anode substrate 320 through the through holes 335*a* and 331*a*.

More specifically, by applying a voltage having a higher positive potential than that of the cathodes 313 to the field control electrode 331, an electric field that extends from the field control electrode 331 toward the surfaces of the cathodes 313 is generated in advance. Subsequently, by applying a voltage to the gate electrodes 335, the gate electrodes 335 are set to have a higher positive potential than that of the cathodes 313. This consequently generates a strong electric field between the gate electrodes 335 and the surfaces (side surfaces) of the through holes 335*a*, and causes the cathodes 313 to extract electrons from the electron-emitting sources disposed on the surfaces of the cathodes 313.

The field control electrode 331, to which the voltage has been applied to set it to have a positive potential with respect to the gate electrodes 335, accelerates the extracted electrons, so the electrons are emitted from the through holes 331*a* toward the front glass 321. At this time, if a positive potential (acceleration voltage) higher than that of the field control electrode 331 is applied to the metal-backed films 324, the electrons emitted from the through holes 331*a* accelerate toward the metal-backed films 324 and pass through the metal-backed films 324 to bombard the phosphor films 323G, 323B, and 323R. This causes the phosphor films to emit light.

As described above, in the flat panel display, the presence of the conductive layers 319 between the glass substrate 311 and cathodes 313 can suppress the vibration of the cathodes 313. The conductive layers 319 can also suppress abnormal (constant) light emission of a non-selected dot.

As has been described above, according to the present invention, the conductive layers are provided between the cathodes and substrate. This can suppress generation of an abnormal dot that constantly emits light during operation, and abnormal vibration of an electrode portion that serves as a cathode.

What is claimed is:

1. A fluorescent display device comprising:

a front glass at least part of which is translucent;

a substrate which is formed of an insulating member arranged to oppose said front glass, said front glass and said substrate constituting part of a vacuum envelope;

a cathode which is disposed on said substrate;

an electron-emitting layer which comprises a carbon nanotube and is formed on a surface of said cathode;

an electron extracting electrode which is arranged between said substrate and said front glass to be spaced apart from said cathode;

a phosphor film and an anode which stack on a surface of said front glass which opposes said substrate;

a conductive layer which is formed between said cathode and said substrate, wherein said cathode comprises a plurality of split electrodes which extend on said substrate to be parallel to each other in a first direction and are arranged at predetermined intervals in a second direction perpendicular to the first direction, said electron extracting electrode comprises a plurality of split electrodes which extend parallel to each other in the second direction and are arranged at predetermined intervals in the first direction, and said conductive layer comprises a plurality of split conductive layers which are formed between said substrate and said plurality of split electrodes and insulated and isolated from each other for each of said plurality of split electrodes.

2. A display according to claim 1, further comprising:

a plurality of substrate ribs which extend parallel to each other in the first direction and stand vertically on said substrate at predetermined intervals in the second direction to support said extracting electrode; and a plurality of insulating members which are in contact with a surface of said substrate and provided to lower portions of said substrate ribs, wherein a side portion of said split conductive layer in the second direction is formed between said substrate and said insulating member.

3. A display according to claim 1, wherein said conductive layer is formed on said substrate to have the same pattern as that of said cathode.

4. A display according to claim 1, wherein said conductive layer is formed to cover a region of said substrate where said cathode is disposed.

* * * * *